US007631870B1

(12) United States Patent
Bennett

(10) Patent No.: US 7,631,870 B1
(45) Date of Patent: Dec. 15, 2009

(54) BOOKS OF THE HOLY BIBLE LEARNING ACTIVITY

(76) Inventor: Daina T Bennett, 1424 4th Ave., Suite 4A, Seattle, WA (US) 98101

( * ) Notice: Subject to any disclaimer, the term of this patent is extended or adjusted under 35 U.S.C. 154(b) by 148 days.

(21) Appl. No.: 11/767,203

(22) Filed: Jun. 22, 2007

Related U.S. Application Data

(60) Provisional application No. 60/817,046, filed on Jun. 27, 2006.

(51) Int. Cl.
*A63F 9/10* (2006.01)

(52) U.S. Cl. ..... 273/157 R

(58) Field of Classification Search ..... 273/157 R, 273/157 A, 153 R; 434/171, 172, 154
See application file for complete search history.

(56) References Cited

U.S. PATENT DOCUMENTS 1,148,885 A * 8/1915 Barrett ..... 273/157 R
1,320,817 A * 11/1919 Yost ..... 273/273
1,359,115 A * 11/1920 Sittinger ..... 434/333
1,359,646 A * 11/1920 Zion ..... 434/322
1,693,711 A * 12/1928 Fritz ..... 434/172
2,481,109 A * 9/1949 Grace ..... 434/333
2,954,616 A * 10/1960 Mogard ..... 434/333
3,242,594 A * 3/1966 Smith ..... 434/96
3,403,460 A * 10/1968 Barrows ..... 434/208
3,707,287 A * 12/1972 Spector ..... 273/157 R
3,909,003 A * 9/1975 Rabinovich ..... 273/157 R
4,586,714 A * 5/1986 Lenkoff et al. ..... 273/157 R
5,062,637 A * 11/1991 Bianchi ..... 273/157 R
5,149,098 A * 9/1992 Bianchi ..... 273/157 R
5,497,991 A * 3/1996 Huang ..... 273/157 R
5,573,246 A * 11/1996 Liao ..... 273/157 R
5,768,382 A * 6/1998 Schneier et al. ..... 380/251
5,893,560 A * 4/1999 McClelland ..... 273/157 R
6,098,980 A * 8/2000 Ramage et al. ..... 273/157 R
6,361,045 B1 * 3/2002 Bernstein ..... 273/157 R
6,702,586 B1 * 3/2004 Miller ..... 434/406
2005/0253336 A1 * 11/2005 Schwartz ..... 273/157 R
2006/0267276 A1 * 11/2006 Farmer et al. ..... 273/157 R

* cited by examiner

*Primary Examiner*—Steven Wong
(74) *Attorney, Agent, or Firm*—Michael I. Kroll

(57) ABSTRACT

A system for teaching information about a topic, a subject, or a book such as the Holy Bible employing at least one puzzle to challenge and convey the information to the user. The information may include may be the names and the books of the bible in the Old and New Testaments. The system can include a information leaflet and a certificate of completion. The certificate of Completion may be in the form of computer readable media. The at least one puzzle includes at least one baseboard, each baseboard for receiving a plurality of pieces. Each baseboard having a game layer with at least one hint, where a single hint on a game layer corresponds to a single one of the plurality pieces.

10 Claims, 11 Drawing Sheets

BOOKS OF THE HOLY BIBLE LEARNING ACTIVITY

CROSS-REFERENCE TO RELATED APPLICATIONS

This application claims priority to a U.S. provisional application whose Ser. No. is 60/817,046, filed 27 Jun. 2006, and is incorporated herein by reference in its entirety.

BACKGROUND OF THE INVENTION

1. Field of the Invention

The present invention relates generally to learning or teaching aids. The present invention relates more specifically to a system of teaching employing at least one puzzle to convey certain information to the user. One specific example is information found in the Holy Bible. A more specific example is the names of the books and the order of the names as they appear in the New and Old Testaments of the Holy Bible.

2. Description of the Prior Art

There are other puzzles designed for educational purposes. While these puzzles may be suitable for the purposes for which they were designed, they would not be suitable for the purposes of the present invention, as hereinafter described.

SUMMARY OF THE PRESENT INVENTION

The present invention is a system for teaching information about a topic, a subject, or a book such as the Holy Bible employing a puzzle or puzzles to challenge and convey the information to the user. One aspect or example described herein is to teach information about the Holy Bible, specifically the names and the order of the Books of the Holy Bible. This is accomplished as a learning activity so that as the user completes the puzzle they absorb the information thereon.

The system of the present invention employs at least one puzzle, listing the sixty-six (66) books of the Holy Bible by name. When the present invention employs one puzzle, all sixty-six books from the Old and New Testament on disposed on a single puzzle. When the present invention employs two puzzles, the Old Testament Book names are on the first puzzle and the New Testament Books names are on the second puzzle.

The names of the books of the Holy Bible employed in the system of the present invention are:

Old Testament—

Genesis, Exodus, Leviticus, Numbers, Deuteronomy, Joshua, Judges, Ruth, I Samuel, II Samuel, I Kings, II Kings, I Chronicles, II Chronicles, Ezra, Nehemiah, Esther, Job, Psalms, Proverbs, Ecclesiastes, Song of Solomon, Isaiah, Jeremiah, Lamentations, Ezekiel, Daniel, Hosea, Joel, Amos, Obadiah, Jonah, Micah, Nahum, Habakkuk, Zephaniah, Haggai, Zechariah, and Malachi.

New Testament—

Matthew, Mark, Luke, John, Acts, Romans, 1 Corinthians, 2 Corinthians, Galatians, Ephesians, Philippians, Colossians, 1 Thessalonians, 2 Thessalonians, 1 Timothy, 2 Timothy, Titus, Philemon, Hebrews, James, 1 Peter, 2 Peter, 1 John, 2 John, 3 John, Jude, Revelations.

The present invention may be employed in a teaching environment such as a school and therefore is preferably made of durable materials such as wood to enable the system to be used over and over again. The system will be provided with a base or platform where the pieces are to be placed. The base employs information in the form of hints to assist the user in positioning the pieces in their proper location on the base. The system enables the user to readily absorb the information found thereon. The system may be packaged with instruction sheets, an instruction book or manual, and may be provided with an answer key. The present invention maybe printed in full color depicting the divisions of the Old and New Testaments.

The system of the present invention may be provided at the retail or wholesale level and may be provided as a trial or demonstration package. The system can be manufactured rapidly and inexpensively and therefore sold at a reasonable price.

The system may or may not include an Introduction and Instruction Manual. The system may or may not include one or two Certificates of Completion. Preferably, the system includes both.

A primary object of the present invention is to provide a system for teaching information.

Another object of the present invention is to provide a system for teaching information contained in the Holy Bible.

A specific object (i.e. example of the information that can be taught) of the system is to teach the name of each book, its correct spelling, and its order as found in the Holy Bible.

Another specific object of the present invention is to teach the association book names and in which testament it belongs, (i.e. new or old).

Another object of the present invention is to provide a planar base having a peripheral lip for receiving and containing the puzzle pieces therein.

Yet another object of the present invention is to provide the base with information in the form of hints to assist the user in placing each piece in its proper location.

Another object of the present invention is to provide hints, where each hint is in the form of the first letter of each book name.

Another object of the present invention is to provide the base with the hints in the same chronological order of they appear within the Holy Bible.

Yet another object of the present invention is to provide each puzzle piece with the name of a single book.

Still yet another object of the present invention where the name of each book covers a plurality of puzzle pieces that once assembled reveal the complete name of the book.

Yet another object of the present invention is to provide a system of learning that is cost effective to manufacture.

Still yet another object of the present invention is to provide a system of learning that is easy and fun to use.

An additional object of the present invention is to provide puzzle pieces that have similar shapes or different shapes to vary the level of difficulty or challenge of the learning system.

A further object of the present invention is to provide puzzle pieces that are randomly sized to increase the level of difficulty or challenge of learning system.

A yet further object of the present invention is to employ colors, pictures, and/or images on the pieces to enhance the aesthetic appeal of puzzle and system.

A still further object of the present invention is to provide color-coded pieces to indicate the testament that it is associated with.

Another object of the present invention is to encourage learning of the information by providing a certificate of successful completion.

An additional object of the present invention is to provide a puzzle(s) made of durable material such as wood and/or plastic.

A further object of the present invention is to optionally provide a puzzle made of cardboard.

A still yet further object of the present invention is to optionally provide a puzzle without a base board.

An object of the present invention is to provide a background design on the pieces to assist the user in completing the puzzle. The background design will preferably be associated or related to the information that is being conveyed to the user. For example, the puzzle may be provided with a background design in the form of a picture of the bible. Background design may in color or black and white, may be a pictures and/or graphic designs.

Additional objects of the present invention will appear as the description proceeds.

The present invention overcomes the shortcomings of the prior art by providing a puzzle having a base with a raised periphery lip for encompassing the plurality of puzzle pieces when assembled. The base further serves as an aid in assembly by providing the first letter of the book name to be placed in that position and where the user can be quizzed on the spelling of the book name prior to placement of the one or more puzzle pieces comprising the book name.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
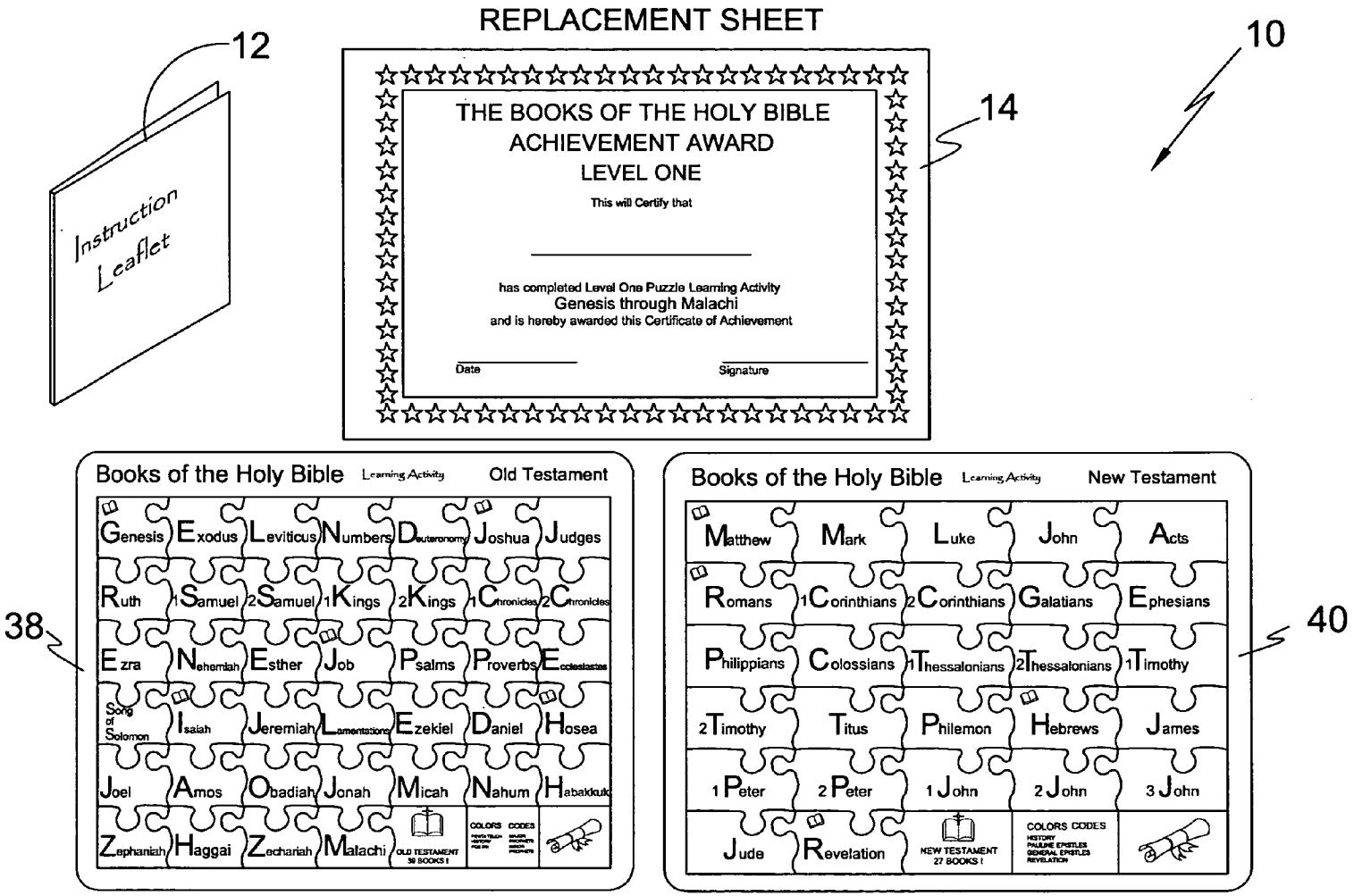
FIG. 1 is an illustrative view of the contents of the present invention.

With regard to reference numerals used, the following numbering is used throughout the drawings.

10 Learning System
12 Instruction Leaflet
14 Certificate of Achievement
16 Baseboard
18 Peripheral Lip
20 Game Layer
22 Hint
24 Puzzle Piece
26 Loose Game Layer
28 Letter
30 Graphic Representation
32 Apple
34 Tree
36 Serpent
38 Old Testament Puzzle
40 New Testament Puzzle
42 Compact Disk
44 Floppy Disk
46 Piece Receiving Area

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring now to the drawings, the learning system 10 of the present invention is illustrated in FIGS. 1-8. FIG. 1, illustrates one variation of the contents of the learning system 10 of the present invention. The learning system 10 of the present invention includes a game having at least one puzzle for conveying information to a user and may include an instruction leaflet 12 and certificates of achievement 14. One specific example of the system of the present invention is to teach a user about the different books of the Holy Bible. There are a total of sixty-six books in the Holy Bible, where thirty-nine from the Old Testament and twenty-seven from the New Testament. The system can employ a single puzzle or two puzzles. A two-puzzle system employs two separate puzzles (see FIG. 1) where each puzzle has it own baseboard 16. Each baseboard 16 has a peripheral lip 18 formed therein or attached thereon that is raised above the game layer 20 to retain the puzzle pieces therein (see FIG. 7). The game layer 20 is provided with information in the form of hints 22 to assist the user in placing the pieces 24 (see FIG. 2). The system of the present invention is designed to teach children and adults of all ages information about the Holy Bible through participation in a fun and active game.

Figure 2:
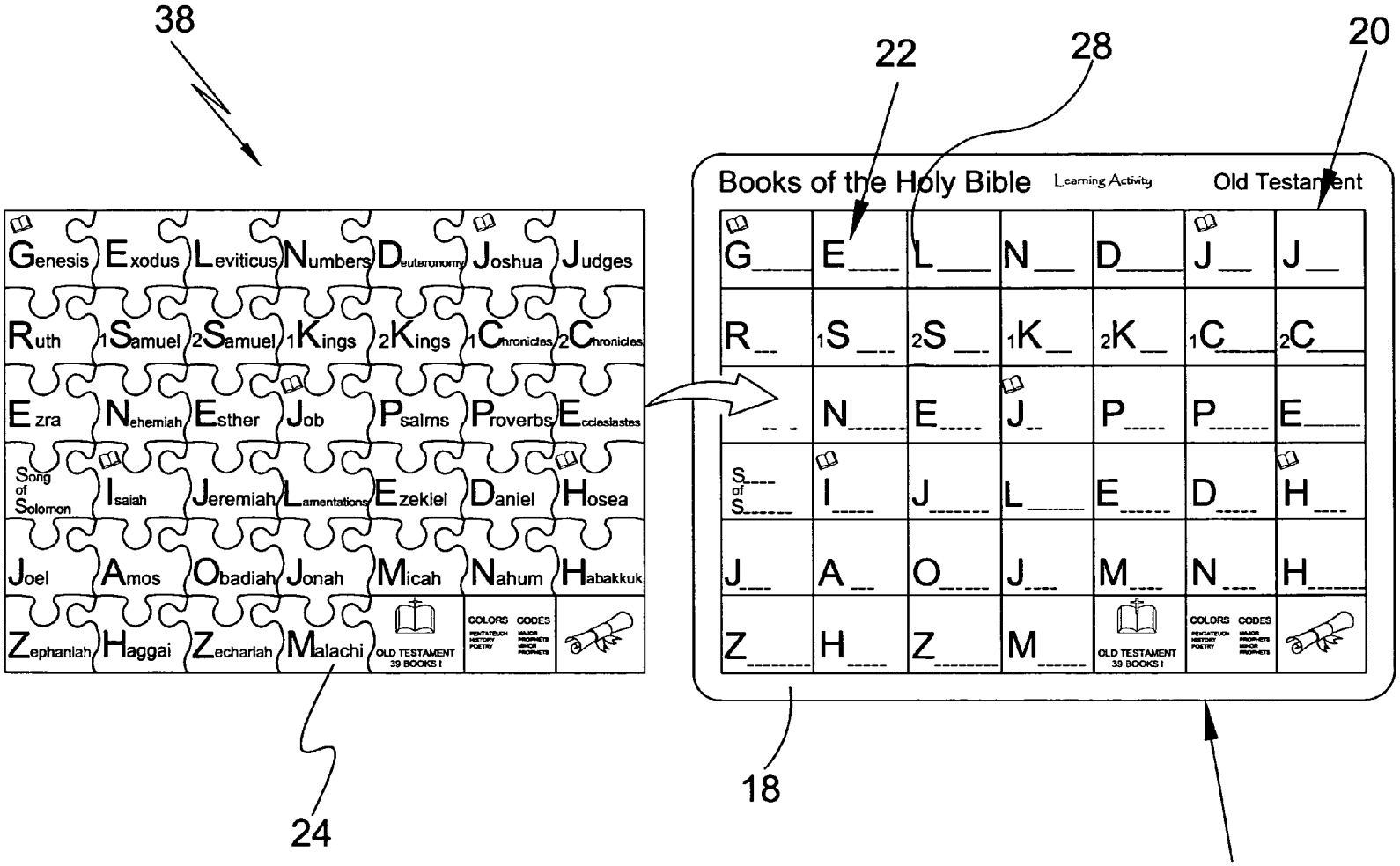
FIGS. 2-2F is a frontal view of the present invention and variations of the puzzle parts.
Figure 2A:
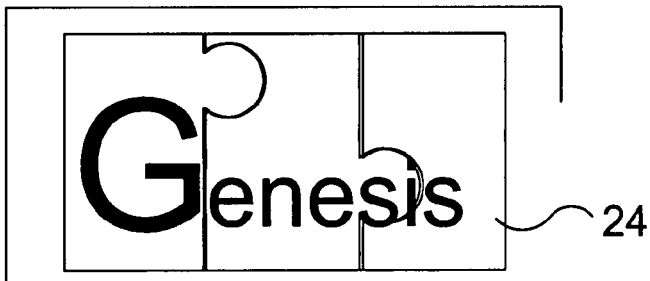
Figure 2B:
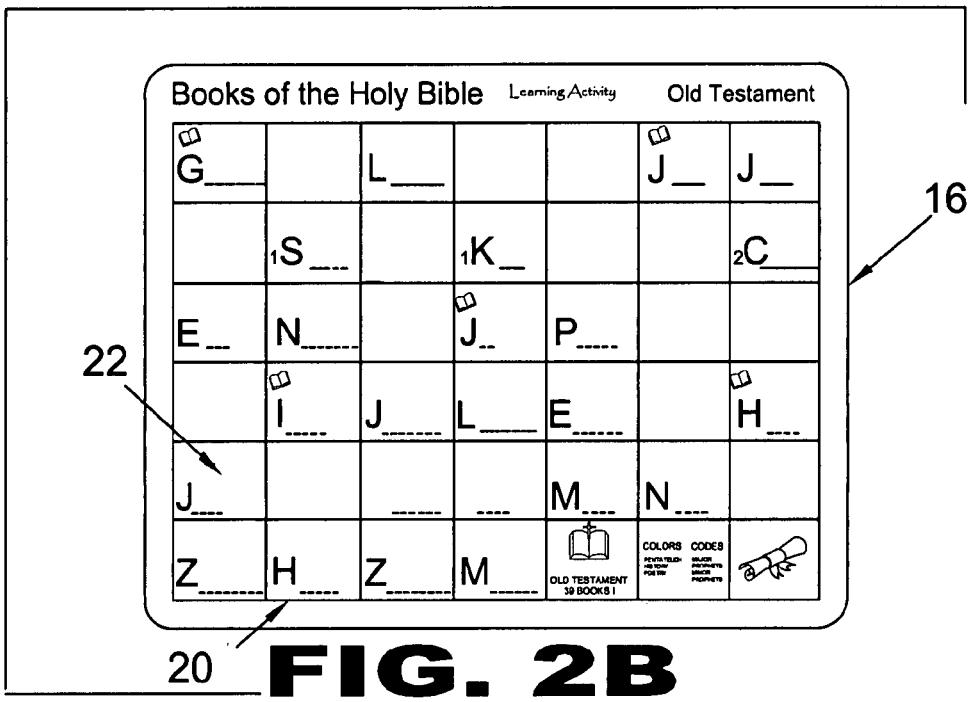
Figure 3:
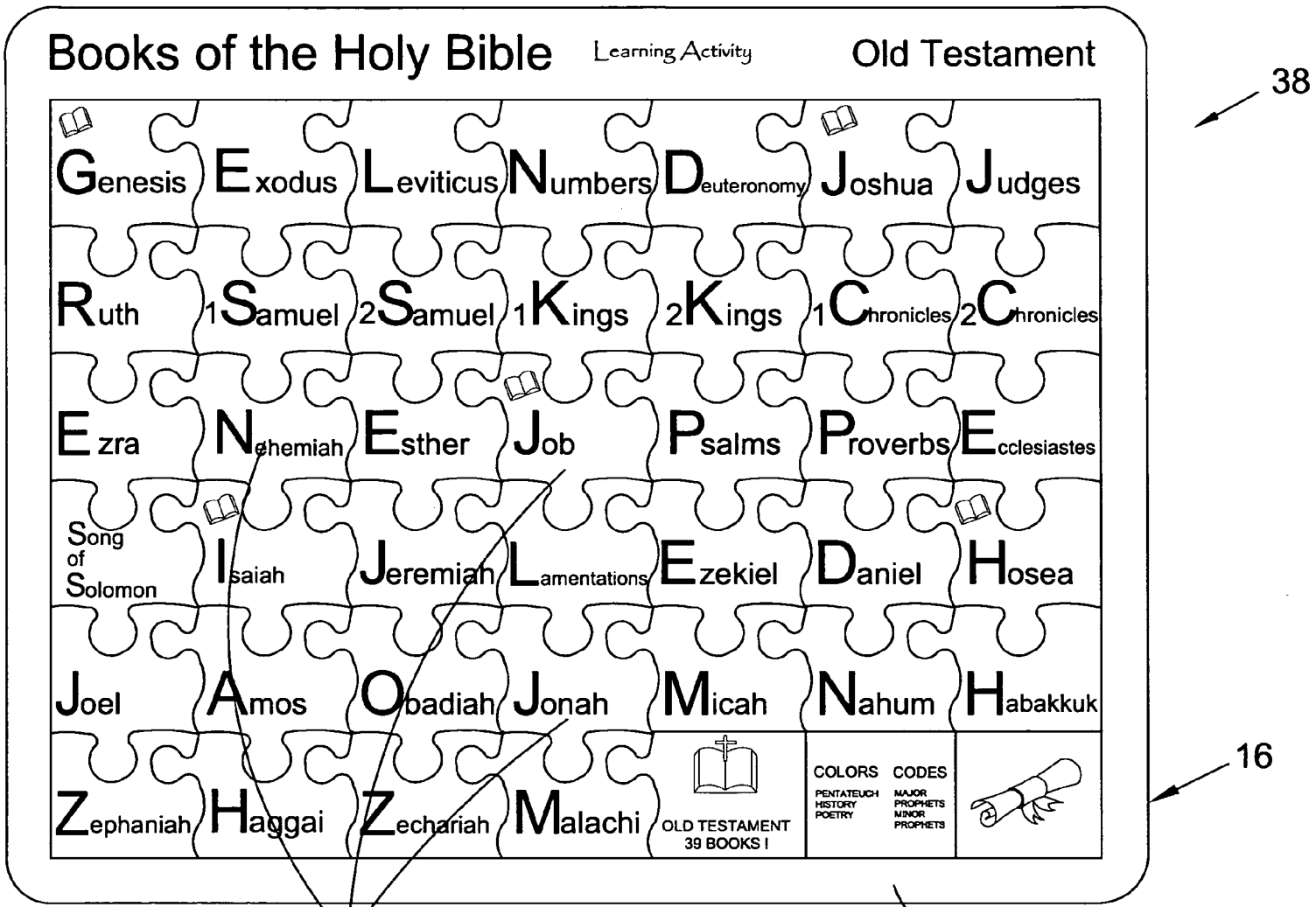
FIG. 3 is a frontal view of the Old Testament puzzle of the present invention.
Figure 4:
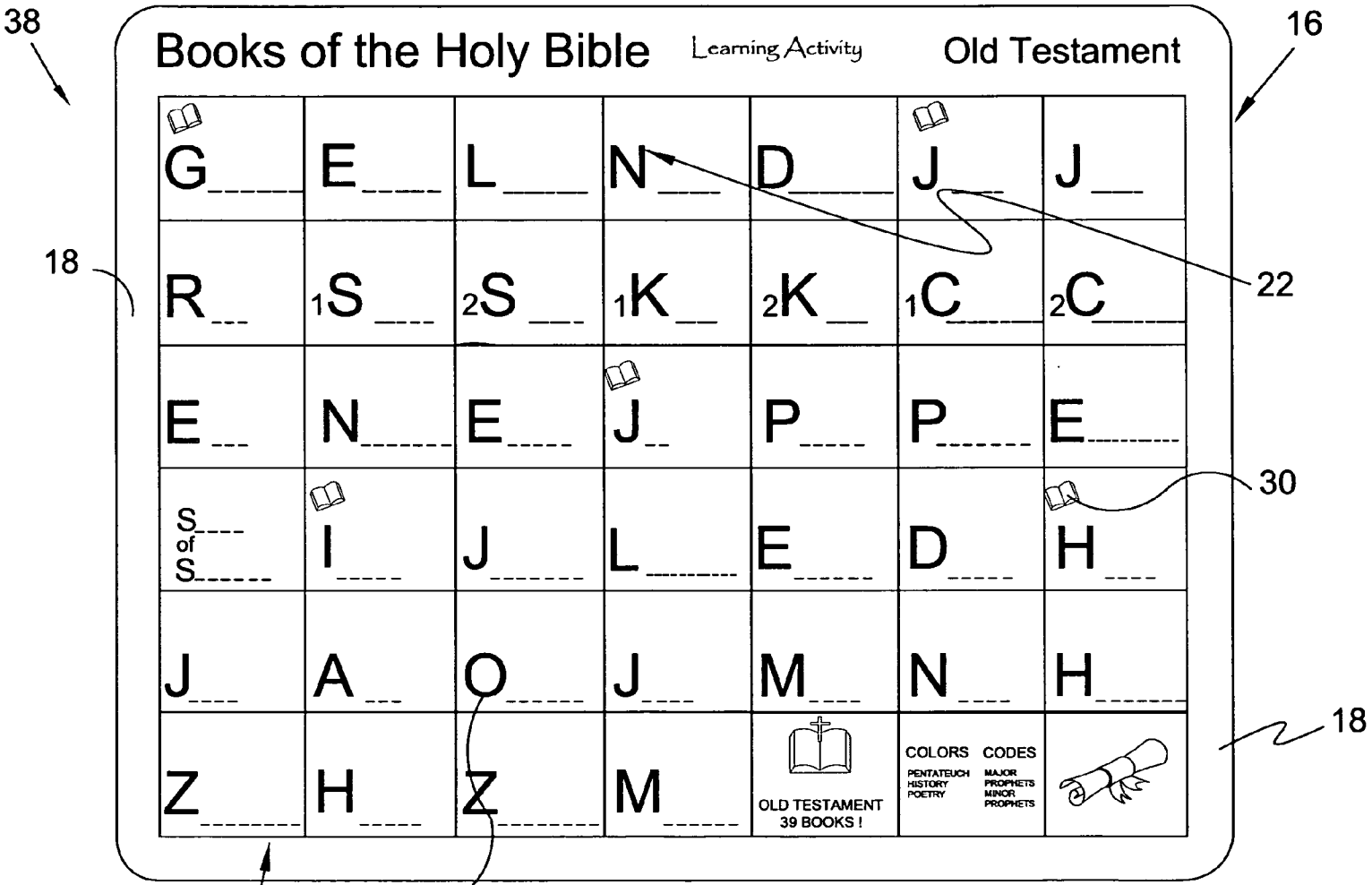
FIG. 4 is a frontal view of the base layer of the Old Testament puzzle of the present invention.

Looking at FIGS. 2-4, the Old Testament puzzle 38 employs at least thirty-nine pieces (one for each book). To provide a rectangular puzzle three additional pieces may be employed to provide an even number of puzzle pieces 24. The pieces 24 are shown where each book name is limited to a single puzzle piece. It is envisioned that the names may cover a plurality of puzzle pieces 24 to provide a greater challenge to the user (see FIG. 2A). The information or hints 22 on the game layer 20 (see FIGS. 2 and 4) may be simply the first letter 28 of the corresponding book of the bible. The game layer 20 is shown as having a hint 22 for each piece 24 but may employ less hints 22 than the number of puzzle pieces 24 to provide an additional challenge to the user (see FIG. 2B). The number of hints 22 employed may range from as few as one to as many as the number of pieces 24. Hints 22 may be provided for the additional pieces that fill out the puzzle as seen in FIG. 2. These are the three puzzle pieces that are located in the lower right corner of the puzzle. The hints 22 for the additional pieces are shown in the lower right corner of the game layer 20 but may be placed any where on the game layer 20 and need not be located next to each other.

Figure 2C:
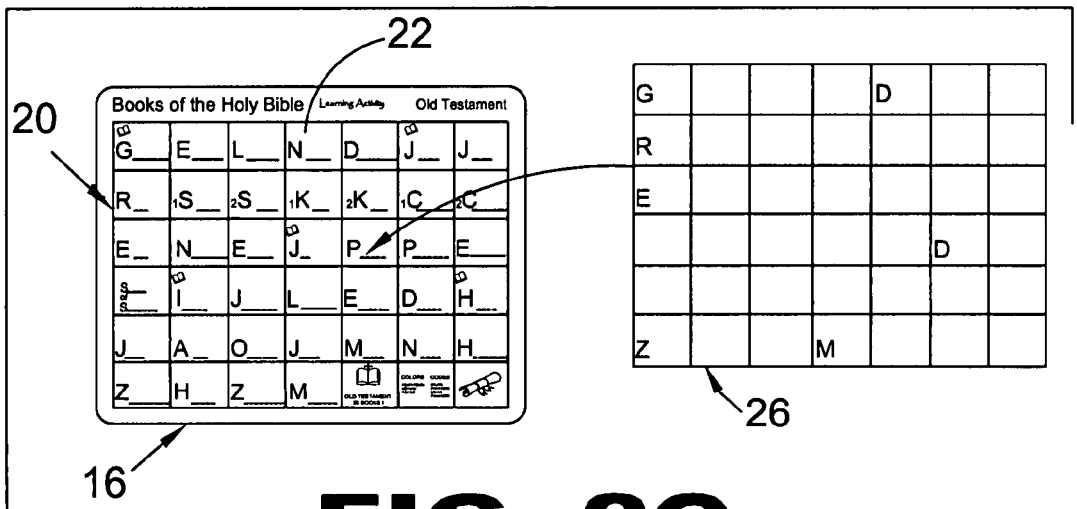
Figure 2D:
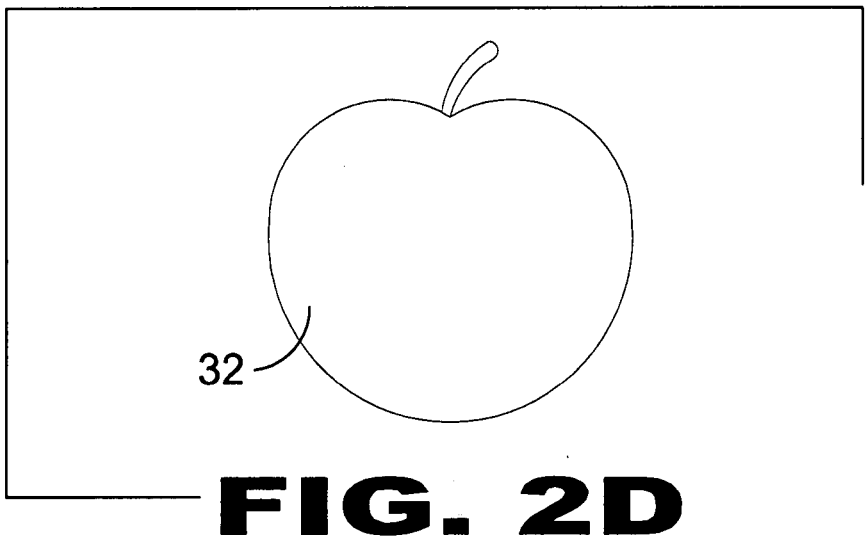
Figure 2E:
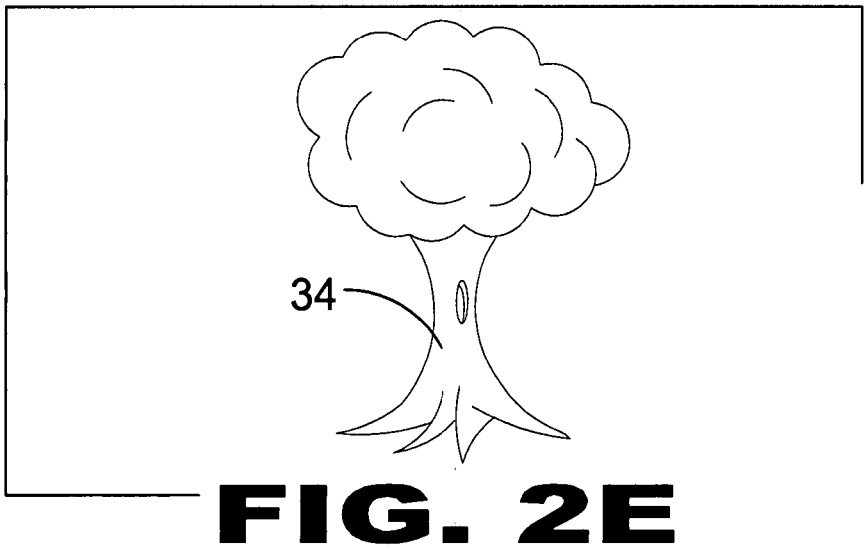
Figure 2F:
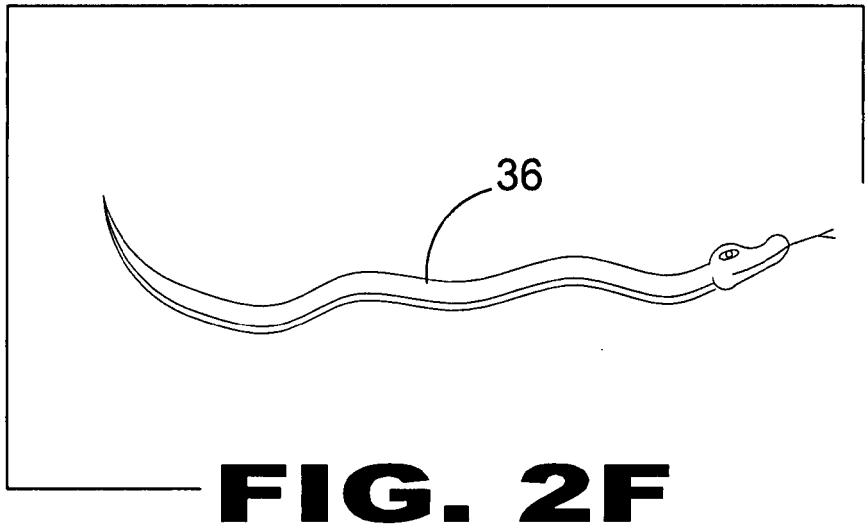

It is within the scope of the present invention to provide at least one loose game layer 26 where each game layer 20 has a different number of hints 22 located thereon to enable the user or teacher to employ a game layer 20 that is suitable for the skill of the user (See FIG. 2C). Symbols, pictures, or other graphic representations 30 may be employed the game layer 20 (see FIG. 2). This allows for another way to convey information to the user or to remind the user of certain events that took place in the book. The graphic representations 30 (i.e. symbols, pictures, etc.) represent or relate to particular events in the book. For example, the hint 22 for the book of Genesis can include a graphic representation 30 of an apple 32, a tree 34, or a serpent 36 (see FIGS. 2D, 2E, and 2F) to remind and reinforce the user of events that took place in the Garden of Eden relating to Adam and Eve. The hints 22 may have a graphic representation 30 in lieu of a letter 28 to present the user with a different puzzle or to present the user with a greater challenge. The hints 22 on a single game layer 20 can be a combination of letters 28 and graphic representations 30. In this situation only some hints employ letters 28 thereby increasing the level of difficulty of the puzzle. In this situation the game layer 20 need not employ a hint 22 for each puzzle piece 24. It is preferable that there is a hint 22 for each puzzle piece 24 since they convey information to the user about that particular book of the Holy Bible and each hint 22 corresponds to a bible passage citation provided in the instruction leaflet 12.

Figure 5:
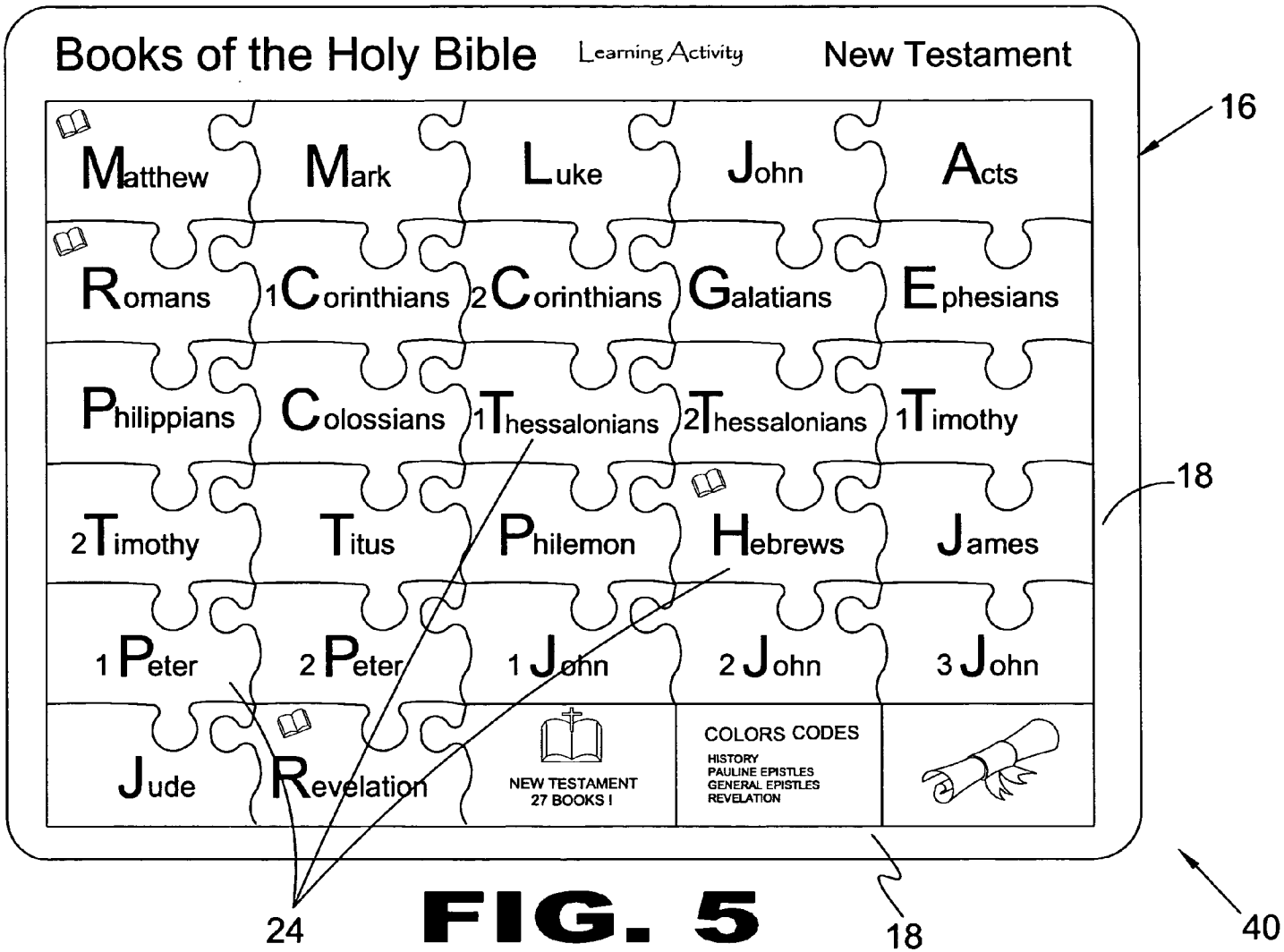
FIG. 5 is a frontal view of the New Testament puzzle of the present invention.
Figure 6:
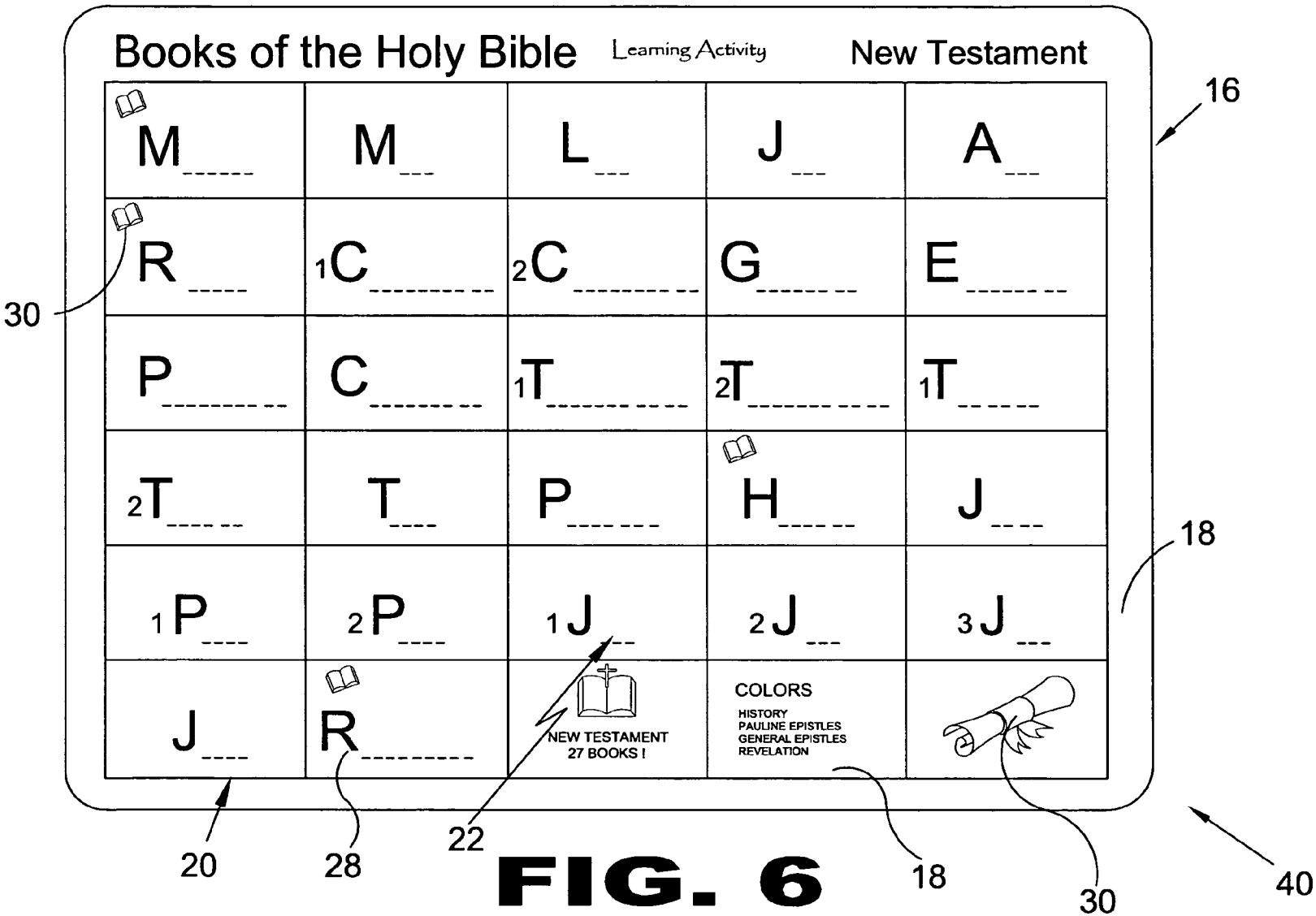
FIG. 6 is a frontal view of the base layer of the New Testament puzzle of the present invention.

Looking at FIGS. 5 and 6 the New Testament puzzle 40 is shown. There are twenty-seven books in the New Testament. This puzzle is similar to the Old Testament puzzle 38 and only differs in the number of puzzle pieces 24. This puzzle may employ any of the features or aspects of the Old Testament puzzle 38 previously described. A certificate of completion 14 is provided for each puzzle and is issued to the student or user once they have mastered that puzzle.

The previously described puzzles may employ a great number of puzzle pieces 24 to increase their difficulty. Each puzzle may employ two thousand (2,000) or more pieces depending upon the level of difficulty that is desired. The puzzle may be made in a variety of sizes depending upon the user. Puzzles intended for small children typically have puzzle pieces larger in size due their lack of manual dexterity. Puzzles found in retail and wholesale establishment may range in size from 5×7 inches to 20×27 inches. The invention is not limited to this range of sizes and the puzzles of the present invention may be made in other sizes as determined by the needs of the user.

Figure 7:
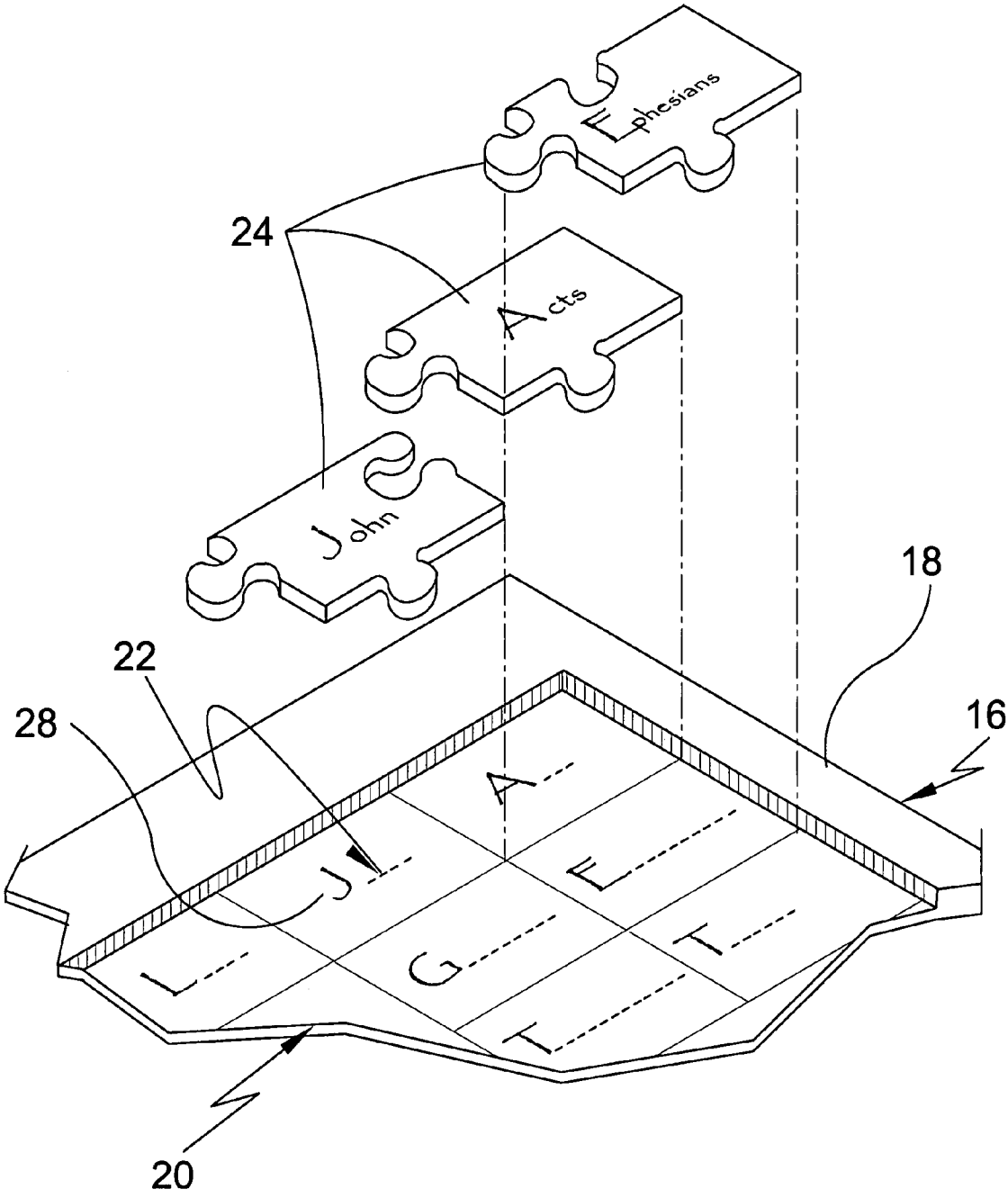
FIGS. 7-7D is a partial perspective view of the base layer and puzzle pieces of the present invention.
Figure 7A:
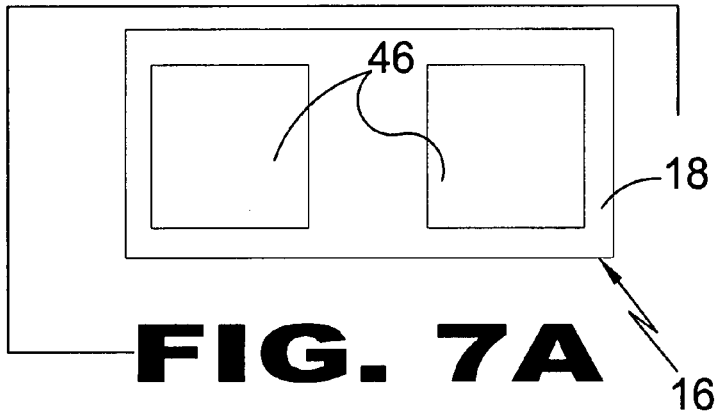
Figure 7B:
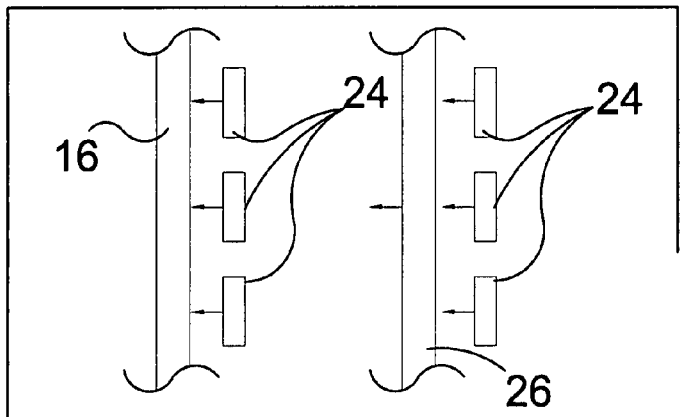
Figure 7C:
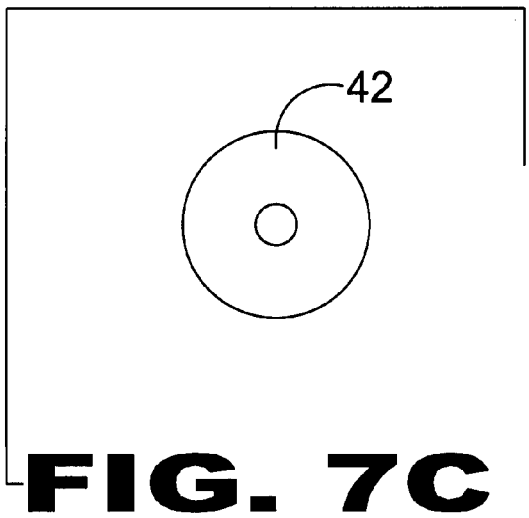
Figure 7D:
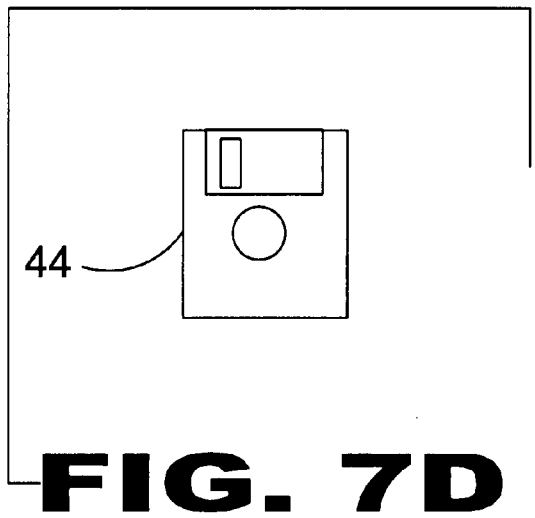
Figure 8:
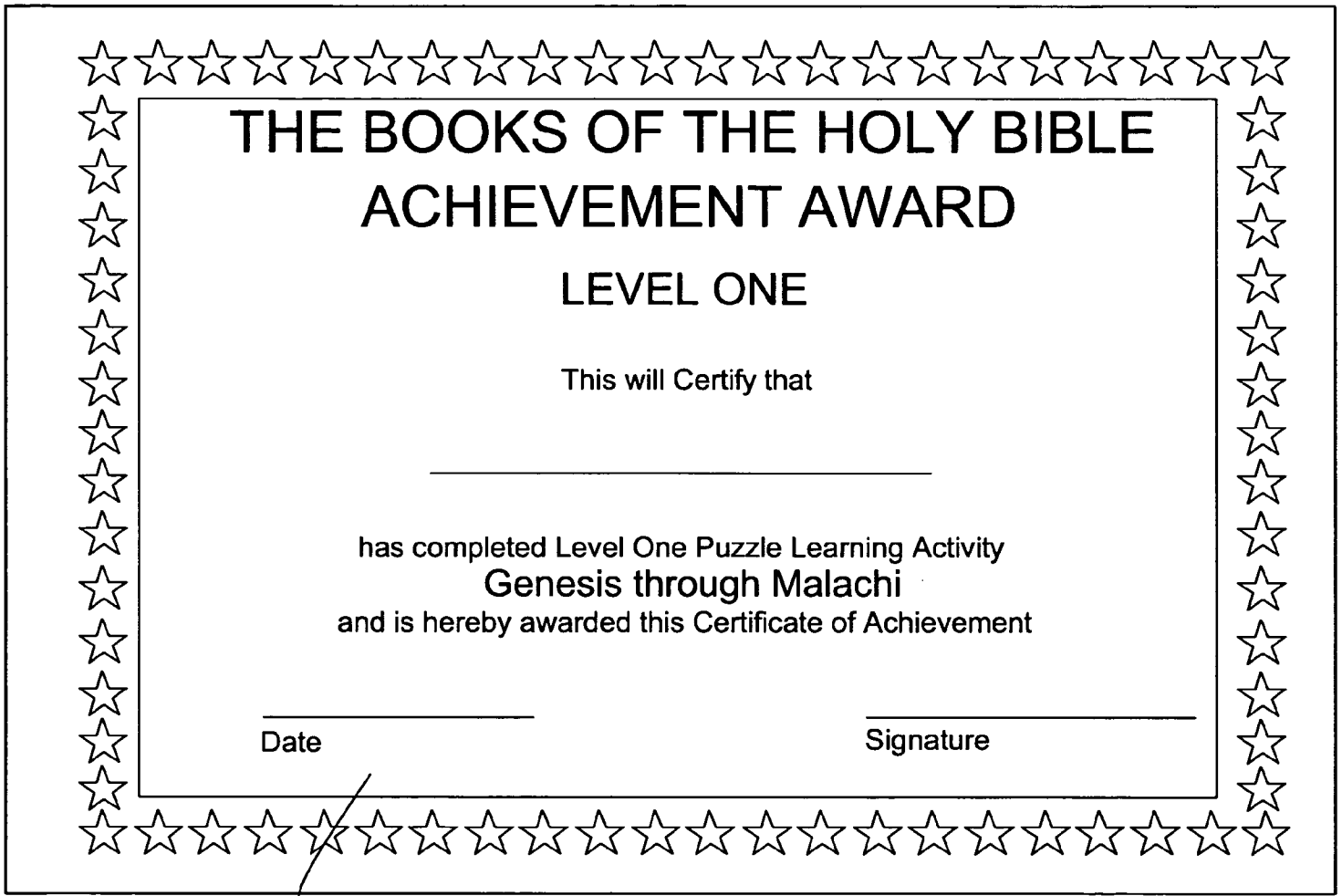
FIG. 8 is a certificate of achievement of the present invention.

The system of the present invention teaches employs sight and touch and may incorporate speech and hearing. The system may incorporate an instruction leaflet 12 directing the teacher or student to different citations or passages in the Holy Bible. The instruction leaflet 12 includes a plurality of bible citations, (i.e. Genesis 1:7), that instruct the teacher or user to read a passage. Each citation corresponds to a single hint 22 on a game layer 24. The correspondence between the passage citations and the hints may be provided in an instructor key. The correlation between a bible passage and a hint 22 enable the user to match the passage or verse to the book in which it is found. When the hints 22 include a graphic representation 30, it is preferable that the citation relates to the graphic representation 30 as well. The teacher and/or students may read aloud the noted passages to positively the citation with the book in which it is located. Reading of the passages aloud provides auditory and speech functions in the teaching method. The present invention may include computer readable media. The computer readable media may be in the form of a compact disk 42 or a floppy disk 44 (see FIGS. 7C and 7D) with means to create additional blank copies of certificates 14 and to create and print personalized certificates on a personal computer. A single puzzle version may employ two separate side-by-side puzzle areas in a single baseboard 16 (see FIG. 7A) or it may employ two vertically stacked puzzles in a single baseboard 16 with a loose game layer 26 that is placed on top of the first puzzle layer (see FIG. 7B). The loose game layer 26 includes the hints 22 and or graphic representations 30 for the second puzzle.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the claims, with equivalents of the claims to be included therein.

I claim:

1. A game for teaching information from the bible, the game comprising:

a flat baseboard having a peripheral lip, a loose game layer on said baseboard enclosed by said peripheral lip, said loose game layer having distributed thereon hints related to different books of the bible, said hints having a particular degree of difficulty, a set of interlocking play pieces, each play piece having a name of a book in the bible and corresponding to a hint on said loose game layer, said set of play pieces adapted to be arranged and interlocked on a top surface of said loose game layer within said peripheral lip whereby when completely assembled each play piece is directly above the hint for that play piece, and another loose game layer for use with said set of interlocking play pieces for being received by said baseboard enclosed by said peripheral lip having distributed thereon hints related to said book of the bible, and having a different degree of difficulty, whereby said game can be used to teach a user information about the bible by proceeding through different degrees of difficulty on loose game layers.

2. The game of claim 1, having a second baseboard along with a second set of loose game layers wherein one baseboard and associated loose game layers are devoted to the Old Testament and a second baseboard and set of loose game layers are devoted to the New Testament.

3. The game of claim 2, wherein the two baseboards are mounted side by side.

4. The game of claim 1, wherein said hints include information about or contained in a book in the bible.

5. The game of claim 4, where each hint is selected from the group consisting of a letter, a symbol, and a picture.

6. A method of teaching the bible comprising the steps of:

placing a first loose game layer on a flat baseboard in an area enclosed by a peripheral lip, said first loose game layer having distributed thereon hints related to different books of the bible, said hints suitable for the skill of a user, placing interlocking play pieces on a top surface of said first loose game layer, each play piece having a name of a book in the bible, placing said play pieces on top of corresponding hints on said first loose game player, whereby said set of play pieces become completely interlocked covering all of said first loose game player when all of said play pieces are directly over a corresponding hint on said first loose game layer, and replacing said first loose game layer with a second loose game layer having distributed thereon hints related to said books and requiring a different degree of skill, placing said interlocking play pieces on a top surface of the second loose game layer, whereby said game is used to teach a user information about the bible by proceeding through different degrees of difficulty on loose game layers.

7. The method of claim 6 in which two baseboards are used side by side, one for the Old Testament and one for the New Testament.

8. The method of claim 6 in which a single hint requires more than one interlocked play piece.

9. The method of claim 6 in which the hints include graphical illustrations of content of the books.

10. The method of claim 6 in which a certificate of completion is issued for completion of each puzzle.

* * * * *